US011136882B2

(12) United States Patent
Gillan et al.

(10) Patent No.: US 11,136,882 B2
(45) Date of Patent: Oct. 5, 2021

(54) AUTOMATED DRILLING INSTRUCTIONS FOR STEERABLE DRILLING SYSTEMS

(71) Applicant: Nabors Drilling Technologies USA, Inc., Houston, TX (US)

(72) Inventors: Colin Gillan, Houston, TX (US); Andrew J. Gorrara, Ræge (NO)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 758 days.

(21) Appl. No.: 15/710,986

(22) Filed: Sep. 21, 2017

(65) Prior Publication Data

US 2019/0085683 A1 Mar. 21, 2019

(51) Int. Cl.

| | |
|---|---|
| ***E21B 47/024*** | (2006.01) |
| ***E21B 44/00*** | (2006.01) |
| ***E21B 47/12*** | (2012.01) |
| ***E21B 47/02*** | (2006.01) |
| ***E21B 7/10*** | (2006.01) |
| ***E21B 7/04*** | (2006.01) |

(52) U.S. Cl.

CPC ..... *E21B 47/024* (2013.01); *E21B 7/04* (2013.01); *E21B 7/10* (2013.01); *E21B 44/005* (2013.01); *E21B 47/02* (2013.01); *E21B 47/12* (2013.01)

(58) Field of Classification Search

CPC ..... E21B 44/02; E21B 44/04; G06F 17/5009; H06F 17/5004

See application file for complete search history.

(56) References Cited

U.S. PATENT DOCUMENTS

| | | | | |
|---|---|---|---|---|
| 8,510,081 | B2 | 8/2013 | Boone et al. | |
| 8,672,055 | B2 | 3/2014 | Boone et al. | |
| 9,290,995 | B2 | 3/2016 | Boone et al. | |
| 2005/0055163 | A1* | 3/2005 | Hopper | E21B 47/09 702/6 |
| 2009/0043510 | A1* | 2/2009 | Allen | G01V 3/20 702/13 |
| 2009/0090555 | A1* | 4/2009 | Boone | E21B 44/02 175/45 |
| 2012/0285746 | A1 | 11/2012 | Kvalvik | |
| 2014/0151121 | A1 | 6/2014 | Boone et al. | |
| 2014/0158428 | A1 | 6/2014 | Boone et al. | |
| 2016/0145993 | A1 | 5/2016 | Gillan et al. | |
| 2016/0237802 | A1 | 8/2016 | Boone et al. | |
| 2017/0058658 | A1* | 3/2017 | Spencer | G06F 30/20 |
| 2017/0243383 | A1 | 8/2017 | Gillan et al. | |
| 2019/0063205 | A1* | 2/2019 | Omeragic | G01V 99/005 |

* cited by examiner

*Primary Examiner* — John R Wallace

(74) *Attorney, Agent, or Firm* — Haynes and Boone, LLP

(57) ABSTRACT

Systems, devices, and methods for directing the operation of a drilling system are provided. The location of a bottom hole assembly (BHA) of a drilling rig may be determined using survey data. One or more steering objective locations may be defined and one or more sets of directional motor instructions are generated to drive the BHA to the one or more steering objective location.

24 Claims, 8 Drawing Sheets

AUTOMATED DRILLING INSTRUCTIONS FOR STEERABLE DRILLING SYSTEMS

TECHNICAL FIELD

The present disclosure is directed to systems, devices, and methods for providing instructions for steerable drilling systems including bent sub and motor bottom hole assemblies (BHA), rotary steerable systems (RSS), and other types of BHAs that can be steered by manipulating drilling systems and/or sending drilling instructions. In particular, the present disclosure includes generating directional motor instructions for a drilling rig.

BACKGROUND OF THE DISCLOSURE

At the outset of a drilling operation, drillers typically establish a drill plan that includes a steering objective location (or target location) and a drilling path to the steering objective location. Once drilling commences, the bottom hole assembly (BHA) may be directed or "steered" from a vertical drilling path in any number of directions, to follow the proposed drill plan. For example, to recover an underground hydrocarbon deposit, a drill plan might include a vertical bore to the side of a reservoir containing a deposit, then a directional or horizontal bore that penetrates the deposit. The operator may then follow the plan by steering the BHA through the vertical and horizontal aspects in accordance with the plan.

In slide drilling implementations, such directional drilling requires accurate orientation of a bent housing of the down hole motor. The bent housing is set on surface to a predetermined angle of bend. The high side of this bend is referred to as the toolface of the BHA. In such slide drilling implementations, rotating the drill string changes the orientation of the bent housing and the BHA, and thus the toolface. To effectively steer the assembly, the operator must first determine the current toolface orientation, such as via measurement-while-drilling (MWD) apparatus. Thereafter, if the drilling direction needs adjustment, the operator must rotate the drill string or alter other surface drilling parameters to change the toolface orientation.

In contrast to steerable motors, rotary steerable system (RSS) systems permit directional drilling to be conducted while the drill string is rotating. As the drill string rotates, frictional forces are reduced and more bit weight is typically available for drilling, which may support faster drilling rates than conventional drilling motors. In RSS implementations, the operator the must make sure that the correct tooface is being maintained by the RSS. This may be achieved by sending instructions to the RSS while it is downhole.

During drilling, a "survey" identifying locational and directional data of a BHA in a well is obtained at various intervals. Each survey yields a measurement of the inclination angle from vertical and azimuth (or compass heading) of the survey probe in a well (typically 40-50 feet behind the total depth at the time of measurement). In directional wellbores, particularly, the position of the wellbore must be known with reasonable accuracy to ensure the correct steering of the wellbore path. The measurements themselves include inclination from vertical and the azimuth of the well bore. In addition to the toolface data, and inclination, and azimuth, the data obtained during each survey may also include hole depth data, pipe rotary data, hook load data, delta pressure data (across the down hole drilling motor), and modeled dogleg data, for example.

These measurements may be taken at discrete points in the well, and the approximate path of the wellbore may be computed from the data obtained at these discrete points. Conventionally, a standard survey is conducted at each drill pipe increment or at each stand length, at approximately every 95 feet, to obtain an accurate measurement of inclination and azimuth for the new survey position.

As a drilling operation proceeds, the operator is required to assess the results of each survey, enter the results into a standalone computer or other calculation device, formulate a visual mental impression of the overall orientation of the drilling BHA, and try to formulate a steering plan for the next 95 feet, based on this mental impression, before steering the system. This can be difficult, time consuming, and complex. Furthermore, this lengthy process can cause delays in drilling. A more efficient, reliable, and intuitive method for steering a BHA with a steerable motor system or RSS is needed.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
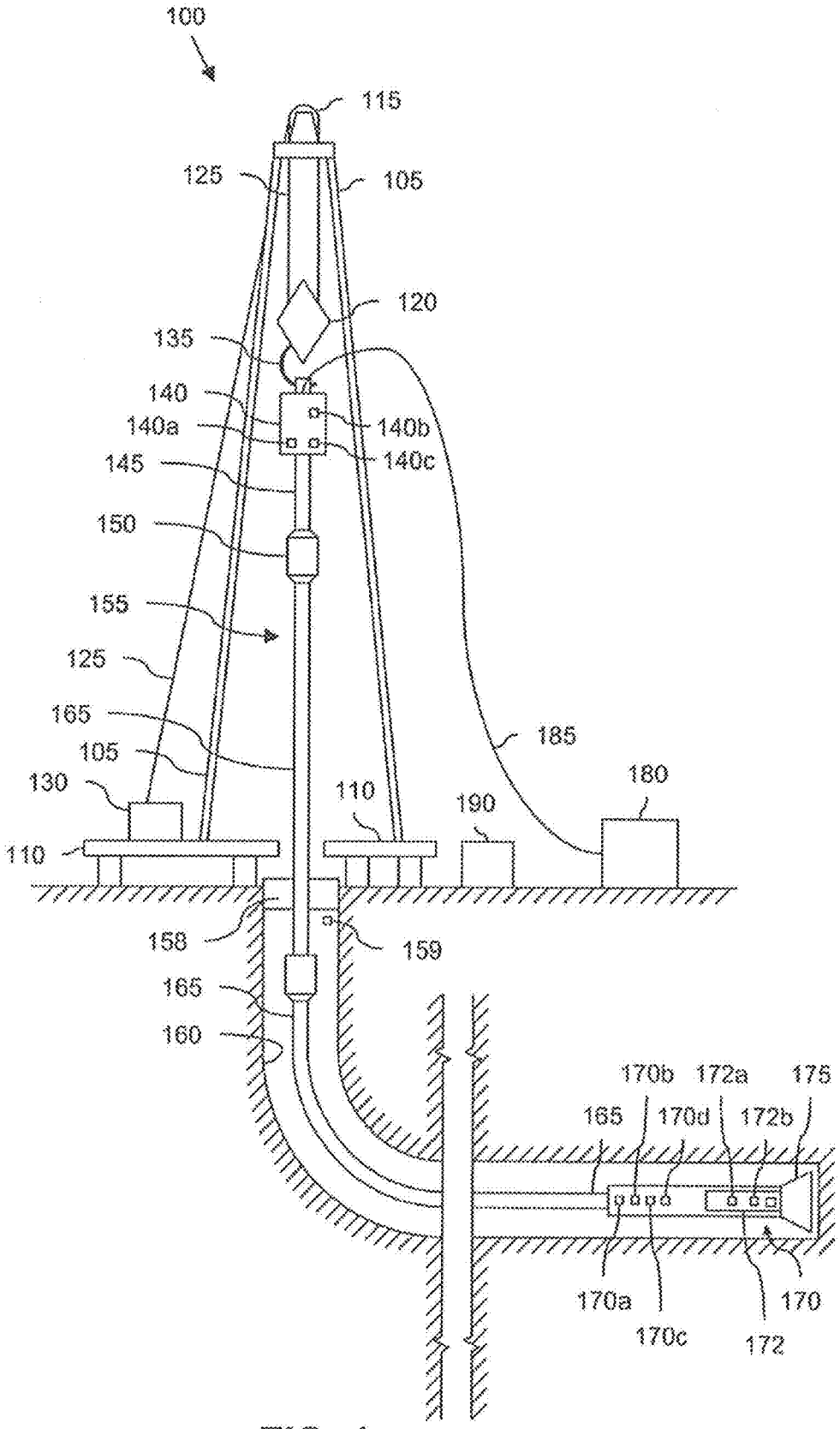
FIG. 1 is a schematic of an exemplary drilling apparatus according to one or more aspects of the present disclosure.

It is to be understood that the following disclosure describes many different implementations, or examples, for implementing different features of various implementations. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various implementations and/or configurations discussed.

This disclosure introduces systems and methods to generate directional motor drilling instructions. In particular, the present disclosure describes the simplified generation of directional motor drilling instructions that may reduce decision making time for a drilling operator, thereby increasing the efficiency and effectiveness of the drilling procedure. In some implementations, the directional motor drilling instructions may be generated "stand by stand;" for example, a new set of instructions may be generated for every stand length of the drill string. These systems and methods may be used to identify the location of a Bottom Hole Assembly (BHA) in a subterranean formation, compare the location to a steering objective location based on a drill plan, generate one or more sets of directional motor drilling instructions to drive a Bottom Hole Assembly (BHA) to the steering objective location, and drive the BHA to or near the steering objective location using the one or more sets of instructions.

Referring to FIG. 1, illustrated is a schematic view of apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel in and out the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe 165, a bottom hole assembly (BHA) 170, and a drill bit 175. The BHA 170 may include stabilizers, drill collars, and/or measurement-while-drilling (MWD) or wireline conveyed instruments, among other components. In some implementations, the BHA 170 includes components of a rotary steerable system (RSS), while in other implementations, the BHA 170 includes a bent housing drilling system.

Implementations using RSS may permit directional drilling to be conducted with the BHA 170 while the drill string continues to rotate. In some implementations, the RSS components may include a drilling motor that forms part of the BHA 170. The RSS components may also include a steering device, such as adjustable skid pads and/or extendable and retractable arms that apply lateral forces along a borehole wall to gradually effect a turn. Additionally and/or alternatively, the RSS components may include components to bend the main drilling shaft to point the bit in a desired direction. Examples of these components are described in European Patent No. EP2707565, which is incorporated herein in its entirety.

As RSS sensor technology improves and the data rate transmitting data from the tool to the surface increases, it may become possible to have real-time survey quality information. In particular, this may avoid the necessity of waiting for the MWD survey at a connection and the well position compared to plan can be continuously updated. In this situation, a more efficient way to generate real-time corrections may be provided by the present disclosure. In addition to inclination, azimuth and toolface data, shock, vibration and other drilling dynamic data may be transmitted from the tool in real-time. This data may be used to adjust the drilling parameters such as WOB and RPM and help reduce the possibility of damaging the BHA and improve drilling efficiency.

Implementations using bent housing drilling systems may require slide drilling techniques to effect a turn using directional drilling. For the purpose of slide drilling, the bent housing drilling systems may include a down hole motor with a bent housing or other bend component operable to create an off-center departure of the bit from the center line of the wellbore. The direction of this departure from the centerline in a plane normal to the centerline is referred to as the "toolface angle." The drill bit 175, which may also be referred to herein as a "tool," may have a "toolface," connected to the bottom of the BHA 170 or otherwise attached to the drill string 155. One or more pumps 180 may deliver drilling fluid to the drill string 155 through a hose or other conduit, which may be connected to the top drive 140.

The down hole MWD or wireline conveyed instruments may be configured for the evaluation of physical properties such as pressure, temperature, torque, weight-on-bit (WOB), vibration, inclination, azimuth, toolface orientation in three-dimensional space, and/or other down hole parameters. These measurements may be made down hole, stored in memory, such as solid-state memory, for some period of time, and downloaded from the instrument(s) when at the surface and/or transmitted in real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, transmission as electromagnetic pulses, among other methods. The MWD sensors or detectors and/or other portions of the BHA 170 may have the ability to store measurements for later retrieval via wireline and/or when the BHA 170 is tripped out of the wellbore 160.

In an exemplary implementation, the apparatus 100 may also include a rotating blow-out preventer (BOP) 158 that may assist when the well 160 is being drilled utilizing under-balanced or managed-pressure drilling methods. The apparatus 100 may also include a surface casing annular pressure sensor 159 configured to detect the pressure in an annulus defined between, for example, the wellbore 160 (or casing therein) and the drill string 155.

In the exemplary implementation depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a down hole motor, and/or a conventional rotary rig, among others.

The apparatus 100 also includes a controller 190 configured to control or assist in the control of one or more components of the apparatus 100. For example, the controller 190 may be configured to transmit operational control signals to the drawworks 130, the top drive 140, the BHA 170 and/or the pump 180. The controller 190 may be a stand-alone component installed near the mast 105 and/or other components of the apparatus 100. In an exemplary implementation, the controller 190 includes one or more systems located in a control room in communication with the apparatus 100, such as the general purpose shelter often referred to as the "doghouse" serving as a combination tool shed, office, communications center, and general meeting place. The controller 190 may be configured to transmit the operational control signals to the drawworks 130, the top drive 140, the BHA 170, and/or the pump 180 via wired or wireless transmission devices which, for the sake of clarity, are not depicted in FIG. 1.

The controller 190 is also configured to receive electronic signals via wired or wireless transmission devices (also not shown in FIG. 1) from a variety of sensors included in the apparatus 100, where each sensor is configured to detect an operational characteristic or parameter. Depending on the implementation, the apparatus 100 may include a down hole annular pressure sensor 170*a* coupled to or otherwise associated with the BHA 170. The down hole annular pressure sensor 170*a* may be configured to detect a pressure value or range in an annulus shaped region defined between the external surface of the BHA 170 and the internal diameter of the wellbore 160, which may also be referred to as the casing pressure, down hole casing pressure, MWD casing pressure, or down hole annular pressure. Measurements from the down hole annular pressure sensor 170*a* may include both static annular pressure (pumps off) and active annular pressure (pumps on).

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

The apparatus 100 may additionally or alternatively include a shock/vibration sensor 170*b* that is configured to detect shock and/or vibration in the BHA 170. The apparatus 100 may additionally or alternatively include a mud motor pressure sensor 172*a* that is configured to detect a pressure differential value or range across one or more motors 172 of the BHA 170. The one or more motors 172 may each be or include a positive displacement drilling motor that uses hydraulic power of the drilling fluid to drive the drill bit 175, also known as a mud motor. One or more torque sensors 172*b* may also be included in the BHA 170 for sending data to the controller 190 that is indicative of the torque applied to the drill bit 175 by the one or more motors 172.

The apparatus 100 may additionally or alternatively include a toolface sensor 170*c* configured to detect the current toolface orientation. The toolface sensor 170*c* may be or include a conventional or future-developed magnetic toolface sensor which detects toolface orientation relative to magnetic north. Alternatively, or additionally, the toolface sensor 170*c* may be or include a conventional or future-developed gravity toolface sensor which detects toolface orientation relative to the Earth's gravitational field. The toolface sensor 170*c* may also, or alternatively, be or include a conventional or future-developed gyro sensor. The apparatus 100 may additionally or alternatively include a WOB sensor 170*d* integral to the BHA 170 and configured to detect WOB at or near the BHA 170.

The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotary speed of the quill 145.

The top drive 140, drawworks 130, crown or traveling block, drilling line or dead line anchor may additionally or alternatively include or otherwise be associated with a WOB sensor 140*c* (WOB calculated from a hook load sensor that can be based on active and static hook load, e.g., one or more sensors installed somewhere in the load path mechanisms to detect and calculate WOB, which can vary from rig to rig) different from the WOB sensor 170*d*. The WOB sensor 140*c* may be configured to detect a WOB value or range, where such detection may be performed at the top drive 140, drawworks 130, or other component of the apparatus 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection elements may include one or more interfaces which may be local at the well/rig site or located at another, remote location with a network link to the system.

Figure 2:
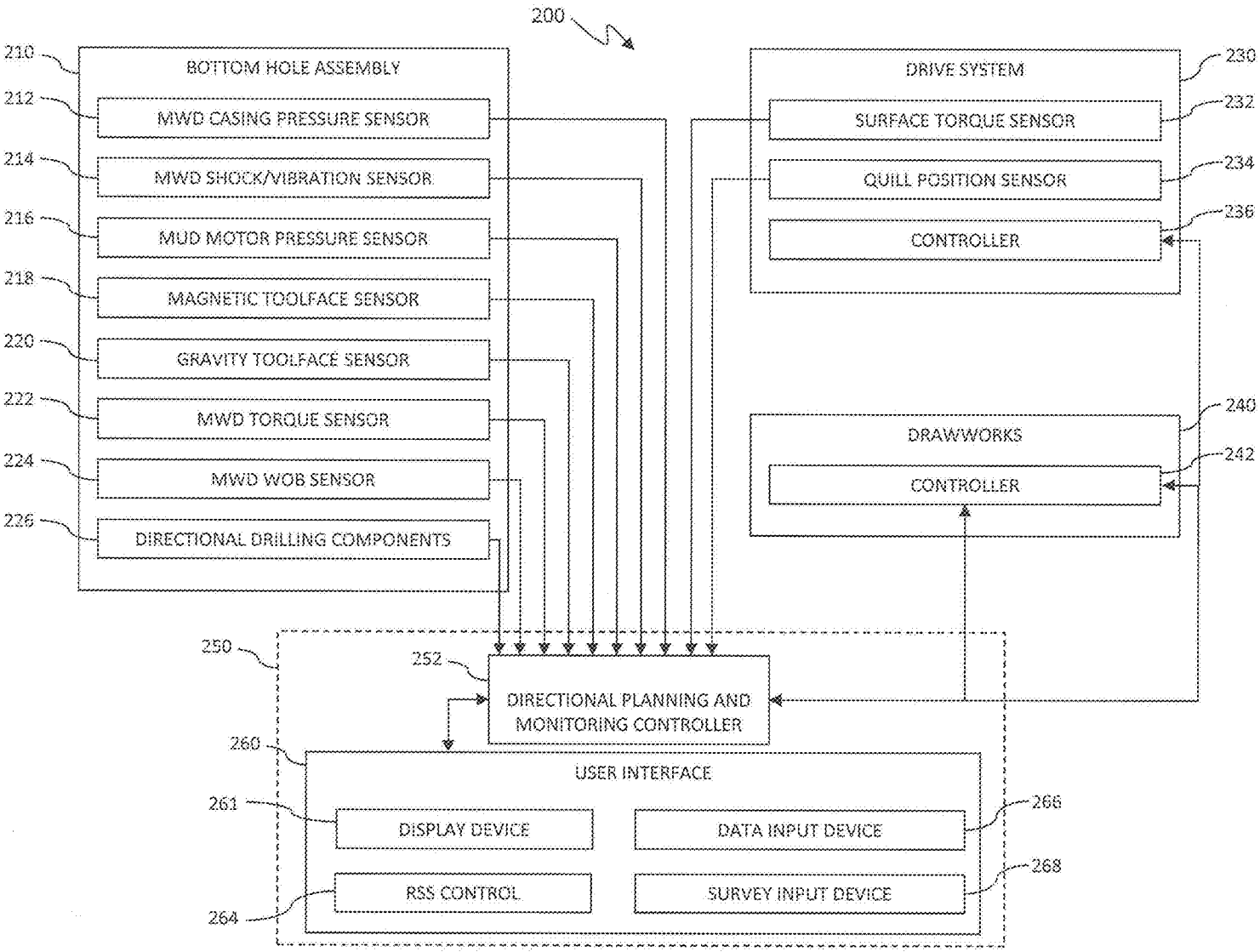
FIG. 2 is a schematic of an exemplary sensor and control system according to one or more aspects of the present disclosure.

Referring to FIG. 2, illustrated is a block diagram of an apparatus 200 according to one or more aspects of the present disclosure. The apparatus 200 includes a user interface 260, a bottom hole assembly (BHA) 210, a drive system 230, a drawworks 240, and a directional planning and monitoring controller 252. The apparatus 200 may be implemented within the environment and/or apparatus shown in FIG. 1. For example, the BHA 210 may be substantially similar to the BHA 170 shown in FIG. 1, the drive system 230 may be substantially similar to the top drive 140 shown in FIG. 1, the drawworks 240 may be substantially similar to the drawworks 130 shown in FIG. 1, and the directional planning and monitoring controller 252 may be substantially similar to the controller 190 shown in FIG. 1.

The user interface 260 and the directional planning and monitoring controller 252 may be discrete components that are interconnected via wired or wireless devices. Alternatively, the user interface 260 and the directional planning and monitoring controller 252 may be integral components of a single system or controller 250, as indicated by the dashed lines in FIG. 2.

The user interface 260 may include a data input device 266 that permits a user to input one or more toolface set points. This may also include inputting other set points, limits, and other input data. The data input device 266 may include a keypad, voice-recognition apparatus, dial, button, switch, slide selector, toggle, joystick, mouse, data base and/or other conventional or future-developed data input device. Such data input device 266 may support data input from local and/or remote locations. Alternatively, or additionally, the data input device 266 may include one or more devices for providing a user selection of predetermined toolface set point values or ranges, such as via one or more drop-down menus. The toolface set point data may also or alternatively be selected by the directional planning and monitoring controller 252 via the execution of one or more database look-up procedures. In general, the data input device 266 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other communication types.

The user interface 260 may also include a survey input device 268. The survey input device 268 may include information gathered from sensors regarding the orientation and location of the BHA 210. In some implementations, survey input device 268 is automatically entered into the user interface at regular intervals.

The user interface 260 may also include a display device 261 arranged to present visualizations of a down hole environment, such as a two-dimensional visualization and/or a three-dimensional visualization. The display device 261 may be used for visually presenting information to the user in textual, graphic, or video form. Depending on the implementation, the display device 261 may include, for example, an LED or LCD display computer monitor, touchscreen display, television display, a projector, or other display device. Some examples of information that may be shown on the display device 261 will be discussed in further detail with reference to FIG. 3.

The user interface 260 may also include a RSS control 264, which may be a system controllable by a directional driller operator configured to control directional drilling components 226 in the BHA. These directional drilling components 226 may include RSS components as well as conventional drilling components, such as bent housing components. The RSS control 264 may include communication components including wired and wireless increments. In some implementations, the RSS control 264 may be configured to send messages to the directional drilling components 226 (including RSS components) through pulses in fluid. The RSS control 264 may also be configured to generate instructions for the RSS components or to receive instructions for the RSS components from the directional planning and monitoring controller 252. In some implementations, a new set of instructions is generated for each stand length of the BHA. In some cases, the set of instructions may be generated during the drilling of a stand length. Alternatively, the set of instructions may be generated after a first stand length has been drilled by the BHA and before the drilling of the next stand length. These instructions may be viewed by an operator and may automatically drive the BHA.

The BHA 210 may include a MWD casing pressure sensor 212 that is configured to detect an annular pressure value or range at or near the MWD portion of the BHA 210, and that may be substantially similar to the down hole annular pressure sensor 170*a* shown in FIG. 1. The casing pressure data detected via the MWD casing pressure sensor 212 may be sent via electronic signal to the directional planning and monitoring controller 252 via wired or wireless transmission.

The BHA 210 may also include an MWD shock/vibration sensor 214 that is configured to detect shock and/or vibration in the MWD portion of the BHA 210, and that may be substantially similar to the shock/vibration sensor 170*b* shown in FIG. 1. The shock/vibration data detected via the MWD shock/vibration sensor 214 may be sent via electronic signal to the directional planning and monitoring controller 252 via wired or wireless transmission.

The BHA 210 may also include a mud motor pressure sensor 216 that is configured to detect a pressure differential value or range across the mud motor of the BHA 210, and that may be substantially similar to the mud motor pressure sensor 172*a* shown in FIG. 1. The pressure differential data detected via the mud motor pressure sensor 216 may be sent via electronic signal to the directional planning and monitoring controller 252 via wired or wireless transmission. The mud motor pressure may be alternatively or additionally calculated, detected, or otherwise determined at the surface, such as by calculating the difference between the surface standpipe pressure just off-bottom and pressure once the bit touches bottom and starts drilling and experiencing torque.

The BHA 210 may also include a magnetic toolface sensor 218 and a gravity toolface sensor 220 that are cooperatively configured to detect the current toolface, and that collectively may be substantially similar to the toolface sensor 170*c* shown in FIG. 1. The magnetic toolface sensor 218 may be or include a conventional or future-developed magnetic toolface sensor which detects toolface orientation relative to magnetic north. The gravity toolface sensor 220 may be or include a conventional or future-developed gravity toolface sensor which detects toolface orientation relative to the Earth's gravitational field. In an exemplary implementation, the magnetic toolface sensor 218 may detect the current toolface when the end of the wellbore is less than about 7° from vertical, and the gravity toolface sensor 220 may detect the current toolface when the end of the wellbore is greater than about 7° from vertical. However, other toolface sensors may also be utilized within the scope of the present disclosure, including non-magnetic toolface sensors and non-gravitational inclination sensors. In any case, the toolface orientation detected via the one or more toolface sensors (e.g., magnetic toolface sensor 218 and/or gravity toolface sensor 220) may be sent via electronic signal to the directional planning and monitoring controller 252 via wired or wireless transmission.

The BHA 210 may also include an MWD torque sensor 222 that is configured to detect a value or range of values for torque applied to the bit by the motor(s) of the BHA 210, and that may be substantially similar to the torque sensor 172*b* shown in FIG. 1. The torque data detected via the MWD torque sensor 222 may be sent via electronic signal to the directional planning and monitoring controller 252 via wired or wireless transmission.

The BHA 210 may also include a MWD WOB sensor 224 that is configured to detect a value or range of values for WOB at or near the BHA 210, and that may be substantially similar to the WOB sensor 170*d* shown in FIG. 1. The WOB data detected via the MWD WOB sensor 224 may be sent via electronic signal to the directional planning and monitoring controller 252 via wired or wireless transmission.

Depending upon the implementation, the BHA 210 may also include one or more directional drilling components 226. These components may include RSS components as well as conventional bent housing system components. In some implementations, the directional drilling components 226 may include a drilling motor that forms part of the BHA 170. The RSS components may include one or more steering devices, such as adjustable skid pads that apply lateral forces along a borehole wall to gradually effect a turn. These components may permit directional drilling to be conducted with the BHA 170 whether or not the drill string continues to rotate. The RSS components may be controlled independently of other components on the drilling rig.

The drawworks 240 may include a controller 242 and/or other devices for controlling feed-out and/or feed-in of a drilling line (such as the drilling line 125 shown in FIG. 1). Such control may include rotary control of the drawworks (in versus out) to control the height or position of the hook, and may also include control of the rate the hook ascends or descends.

The drive system 230 may include a surface torque sensor 232 that is configured to detect a value or range of the reactive torsion of the quill or drill string, much the same as the torque sensor 140*a* shown in FIG. 1. The drive system 230 also includes a quill position sensor 234 that is configured to detect a value or range of the rotary position of the quill, such as relative to true north or another stationary reference. The surface torsion and quill position data detected via the surface torque sensor 232 and the quill position sensor 234, respectively, may be sent via electronic signal to the directional planning and monitoring controller 252 via wired or wireless transmission. The drive system 230 also includes a controller 236 and/or other devices for controlling the rotary position, speed and direction of the quill or other drill string component coupled to the drive system 230 (such as the quill 145 shown in FIG. 1).

The directional planning and monitoring controller 252 may be configured to receive one or more of the above-described parameters from the user interface 260, the BHA 210, the drawworks 240, and/or the drive system 230, and utilize such parameters to continuously, periodically, or otherwise determine the current toolface orientation. The directional planning and monitoring controller 252 may be further configured to generate a control signal, such as via intelligent adaptive control, and provide the control signal to the drive system 230 and/or the drawworks 240 to adjust and/or maintain the toolface orientation. For example, the directional planning and monitoring controller 252 may provide one or more signals to the drive system 230 and/or the drawworks 240 to increase or decrease WOB and/or quill position, such as may be required to accurately "steer" the drilling operation. The directional planning and monitoring controller 252 may also be configured to provide signals to the RSS components to change the RSS drilling control parameters.

Figure 3:
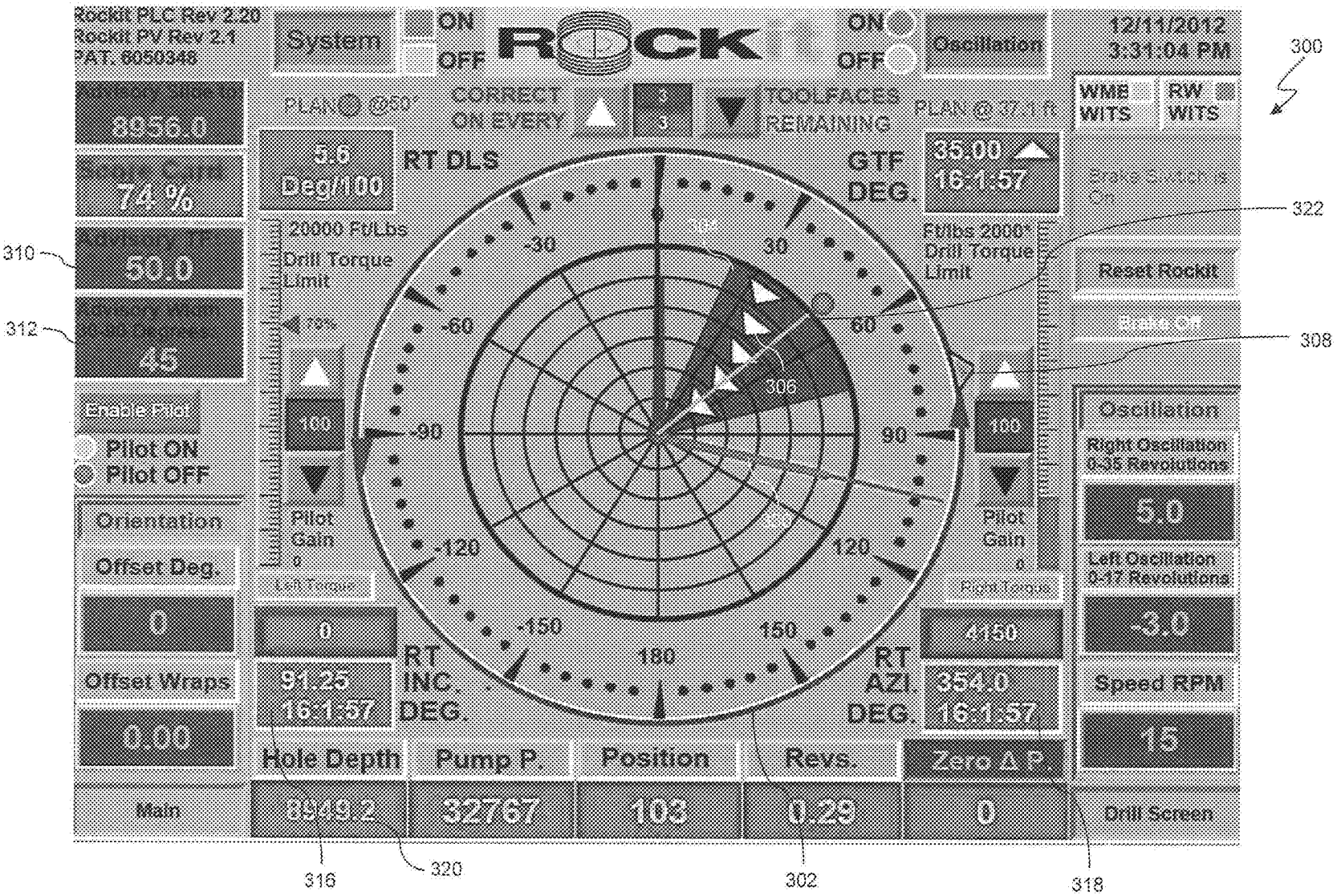
FIG. 3 is a schematic of an exemplary display apparatus showing a two-dimensional visualization.

FIG. 3 shows a schematic view of a human-machine interface (HMI) 300 according to one or more aspects of the present disclosure. The HMI 300 may be utilized by a human operator during directional and/or other drilling operations to monitor the relationship between toolface orientation and quill position. The HMI 300 may include aspects of the ROCKit® HMI display of Canrig Drilling Technology, LTD. In an exemplary implementation, the HMI 300 is one of several display screens selectably viewable by the user during drilling operations, and may be included as or within the human-machine interfaces, drilling operations and/or drilling apparatus described in the systems herein. The HMI 300 may also be implemented as a series of instructions recorded on a computer-readable medium, such as described in one or more of these references. In some implementations, the HMI 300 is the two-dimensional visualization 262 of FIG. 2.

The HMI 300 is used by a user, who may be a directional driller operator, while drilling to monitor the status and direction of drilling using the BHA. The directional planning and monitoring controller 252 of FIG. 2 may drive one or more other human-machine interfaces during drilling operation and may be configured to also display the HMI 300 on the display device 261. The directional planning and monitoring controller 252 driving the HMI 300 may include a "survey" or other data channel, or otherwise includes devices for receiving and/or reading sensor data relayed from the BHA 170, a measurement-while-drilling (MWD) assembly, a RSS assembly, and/or other drilling parameter measurement devices, where such relay may be via the Wellsite Information Transfer Standard (WITS), WITS Markup Language (WITS ML), and/or another data transfer protocol. Such electronic data may include gravity-based toolface orientation data, magnetic-based toolface orientation data, azimuth toolface orientation data, and/or inclination toolface orientation data, among others.

As shown in FIG. 3, the HMI 300 may be depicted as substantially resembling a dial or target shape 302 having a plurality of concentric nested rings. The HMI 300 also includes a pointer 330 representing the quill position. Symbols for magnetic toolface data and gravity toolface data symbols may also be shown. In the example of FIG. 3, gravity toolface angles are depicted as toolface symbols 306. In one exemplary implementation, the symbols for the magnetic toolface data are shown as circles and the symbols for the gravity toolface data are shown as rectangles. Of course, other shapes may be utilized within the scope of the present disclosure. The toolface symbols 306 may also or alternatively be distinguished from one another via color, size, flashing, flashing rate, and/or other graphic elements.

In some implementations, the toolface symbols 306 may indicate only the most recent toolface measurements. However, as in the exemplary implementation shown in FIG. 3, the HMI 300 may include a historical representation of the toolface measurements, such that the most recent measurement and a plurality of immediately prior measurements are displayed. Thus, for example, each ring in the HMI 300 may represent a measurement iteration or count, or a predetermined time interval, or otherwise indicate the historical relation between the most recent measurement(s) and prior measurement(s). In the exemplary implementation shown in FIG. 3, there are five such rings in the dial 302 (the outermost ring being reserved for other data indicia), with each ring representing a data measurement or relay iteration or count. The toolface symbols 306 may each include a number indicating the relative age of each measurement. In the present example, the outermost triangle of the toolface symbols 306 corresponds to the most recent measurement. After the most recent measurement, previous measurements are positioned incrementally towards the center of the dial 302. In other implementations, color, shape, and/or other indicia may graphically depict the relative age of measurement. Although not depicted as such in FIG. 3, this concept may also be employed to historically depict the quill position data. In some implementations, measurements are taken every 10 seconds, although depending on the implementation, measurements may be taken at time periods ranging from every second to every half-hour. Other time periods are also contemplated.

The HMI 300 may also include a number of textual and/or other types of indicators 316, 318, 320 displaying parameters of the current or most recent toolface orientation. For example, indicator 316 shows the inclination of the wellbore, measured by the survey instrument, as 91.25°. Indicator 318 shows the azimuth of the wellbore, measured by the survey instrument as 354°. Indicator 320 shows the hole depth of the wellbore as 8949.2 feet. In the exemplary implementation shown, the HMI 300 may include a programmable advisory width. In the example of FIG. 3, this value is depicted by advisory width sector 304 with an adjustable angular width corresponding to an angular setting shown in the corresponding indicator 312, in this case 45°. The advisory width is a visual indicator providing the user with a range of acceptable deviation from the advisory toolface direction. In the example of FIG. 3, the toolface symbols 306 all lie within the advisory width sector 304, meaning that the user is operating within acceptable deviation limits from the advisory toolface direction. Indicator 310 gives an advisory toolface direction, corresponding to line 322. The advisory toolface direction represents an optimal direction towards the drill plan. Indicator 308, shown in FIG. 3 as an arrow on the outermost edge of the dial 302, is an indicator of the overall resultant direction of travel of the toolface. This indicator 308 may present an orientation that averages the values of other indicators 316, 318, 320. Other values and depictions are included on the HMI 300 that are not discussed herein. These other values include the time and date of drilling, aspects relating to the operation of the drill, and other received sensor data.

FIGS. 4A-4H show exemplary representations of a down hole environment 400 including a down hole portion of a drilling system including a BHA 406 and drill string 408. In some implementations, instructions to drive the BHA 406 to various drilling targets or steering objective locations in the down hole environment 400. The drill string 408 may be made up of a number of tubulars. The BHA 406 and drill string 408 correspond to the BHA 170 and drill string 155 in FIG. 1, and may form a portion of the drilling apparatus 100 described with reference to FIG. 1. FIGS. 4A-4H show the BHA 406 and drill string 408 within a drilled bore, with an end of the drilled bore designated by the reference number 404, and referred to herein as a bore end 404. The bore end 404 may represent the bottom of a wellbore 402 drilled by the BHA 406. In some implementations, the bore end 404 corresponds to the location of the BHA 406, and the location of the bore end 404 may be determined by determining the location of the BHA 406. In some implementations, the location of the BHA 406, and therefore the location of the bore end 404, is determined each time that a tubular or stand is introduced to the drill string. In some implementations, a stand is made up of a number of tubulars. In some implementations, the location of the bore end 404 is determined every 95 feet. Of course, some tubulars or stands have lengths greater than or less than 95 feet, and the systems described herein, utilizing the directional planning and monitoring controller 252 in FIG. 2, may be configured to determine the location of the BHA 406 and bore end 404 at other incremental lengths.

In some implementations, the directional planning and monitoring controller 252 may determine the location of the BHA 406 and bore end 404 by conducting a survey each time a new tubular or stand is introduced to the drill string. Accordingly, when stands having a length of approximately 95 feet are introduced to the drill string, the survey may be taken every 95 feet. The results of this survey, identifying the location and orientation of the BHA 406, may be compared with a drill plan stored in the controller 250 to determine whether the path of the BHA 406 conforms to the drill plan and/or is within a given tolerance distance, or an acceptable deviation, from the drill plan. The acceptable deviation may be a predetermined value that may form part of the drill plan. With the survey known, the directional planning and monitoring controller 252 may use the survey to generate a steering objective location 410 (or a target location) to which the BHA should be steered to follow the well plan. In some implementations, the steering objective location 410 is surrounded by a tolerance area 411. The tolerance area 411 may represent a zone of acceptable tolerance for the BHA around the steering objective location 410. In some implementations, the tolerance area 411 has a circular or elliptical shape that is centered on the steering objective location 410. In other implementations, the tolerance area 411 is offset from the steering objective location 410 and/or has different shapes, such as rectangular, polygonal, etc. The steering objective location 410 may be located along the drill plan or may be generated to steer the BHA 406 closer to the drill plan. The steering objective location 410 may also correspond to the expected position of the next survey. For example, when surveys are taken at every 95 feet of drilling, the steering objective location may be calculated to be about 95 feet from the bore end 404 after the most recent survey. In this manner, the drilling direction may be updated while drilling in 95 feet increments. This may help ensure that the actual drilled bore corresponds at least generally to the drill plan. Although 95 foot increments are used as an example, it should be apparent that any incremental length could be used, and that the incremental length may correspond to the length of a tubular or stand introduced into the drill string.

When the bore end 404 and the steering objective location 410 are known, the directional planning and monitoring controller 252 may determine a desired drill path 412 to move the BI-IA 406 from the current bore end 404 to the tolerance area 411 or steering objective location 410. The monitoring controller 252 may generate one or more sets of directional motor instructions to steer the BHA 406 to the tolerance area 411 or steering objective location 410.

Figure 4B:
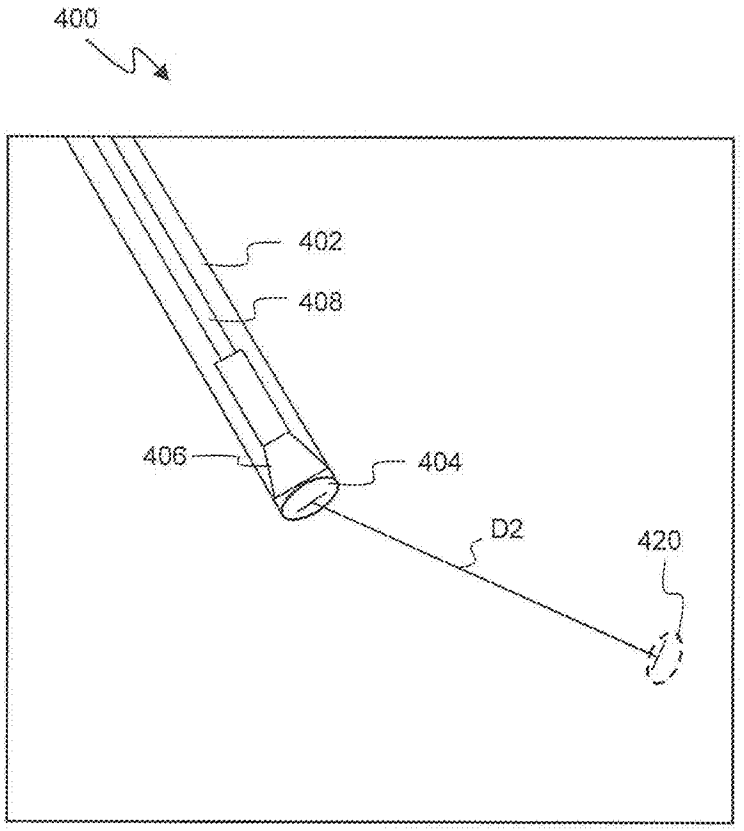
FIG. 4B is another representation of a down hole environment including a wellbore according to one or more aspects of the present disclosure.
Figure 4A:
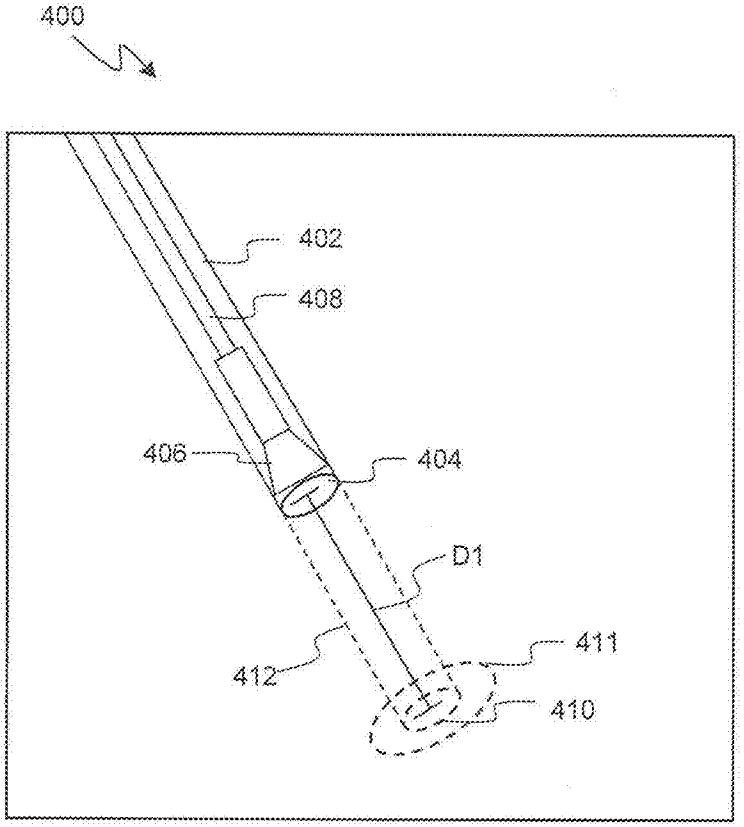
FIG. 4A is a representation of a down hole environment including a wellbore according to one or more aspects of the present disclosure.

In the example of FIG. 4A, the directional planning and monitoring controller 252 may be used to determine the steering objective location 410 a distance D1 along the drill path as a steering objective for the BHA 406. The distance D1 may correspond to the length of a stand or tubular introduced to the drill string, or may be some other length. In the example shown in FIG. 4A, the steering objective location 410 may be considered "in line" with the wellbore 402, and therefore may not require any adjustment of the BHA's 406 orientation. In this example, the directional driller operator may drill the distance D1 along the drill path 412 with the BHA 406 straight ahead without changing the orientation of the BHA 406 to arrive at the steering objective location 410. In this case, repositioning of the toolface (to effect a turn in the drilling path) is not required. Accordingly, since there is no need to change directions, the RSS components in the BHA 406 need not be used to reorient the BHA 406, or alternatively, slide drilling is not required.

Figure 4D:
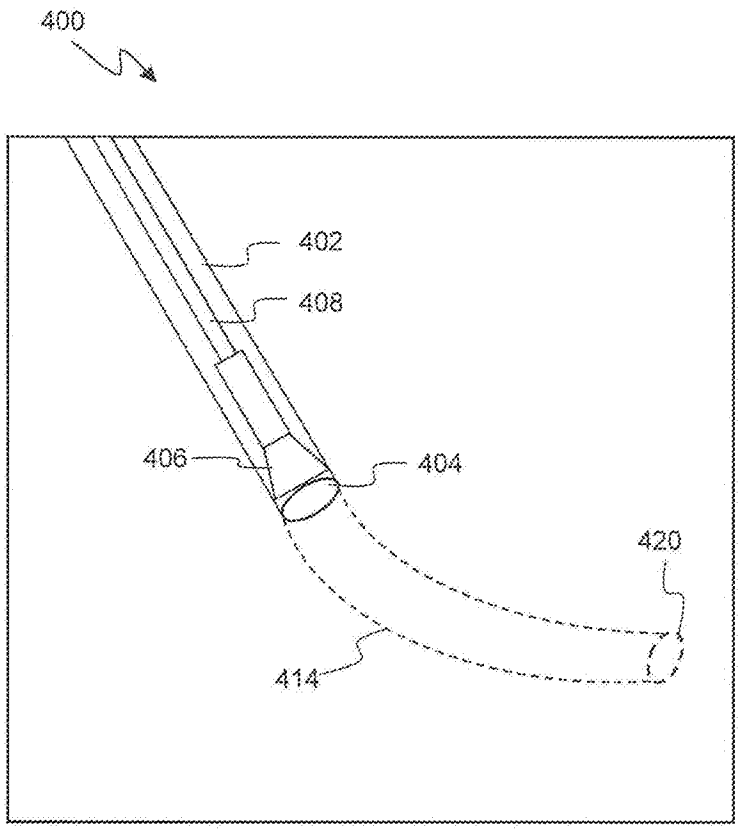
FIG. 4D is another representation of a down hole environment including a wellbore according to one or more aspects of the present disclosure.
Figure 4C:
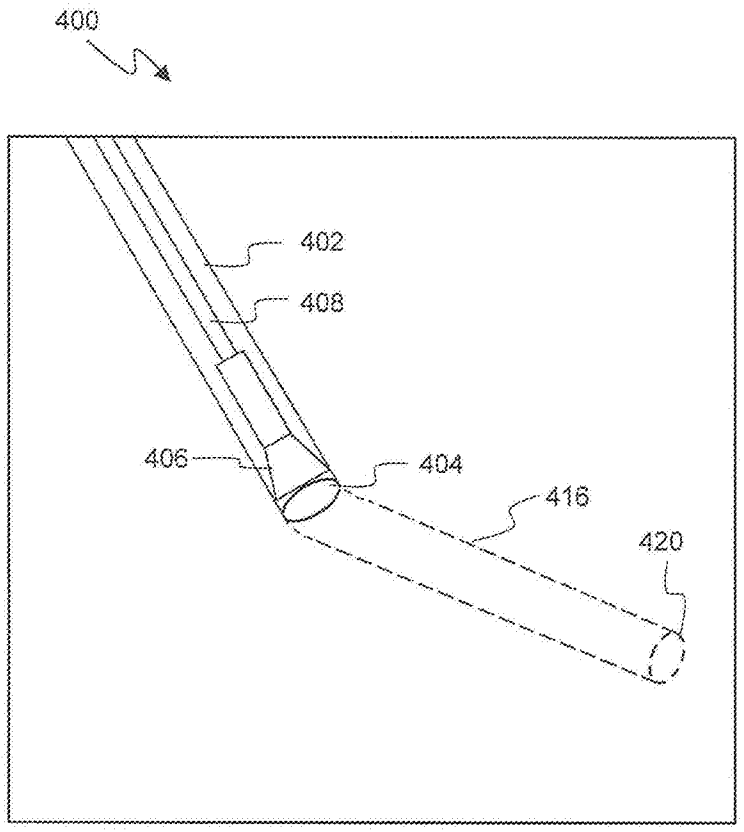
FIG. 4C is another representation of a down hole environment including a wellbore according to one or more aspects of the present disclosure.

FIG. 4B shows a representation of a down hole environment 400 with a bore end 404 which may be determined by a survey and a steering objective location 420 that is not in line with the wellbore 402. The steering objective location 420 is located a distance D2 from the bore end. In some implementations, the distance D2 may represent the distance of a tubular or stand being introduced to the drill string. Similar to the steering objective location 410 in FIG. 4A, the steering objective location 420 of FIG. 4B may be determined at a point on a pre-determined drill path, or may be determined as an intermediate point direct in the wellbore 402 toward the predetermined drill path. In the example of FIG. 4B, the system may be used to generate instructions to move the BHA from the bore end 404 to the steering objective location 420. In some implementations, the directional planning and monitoring controller 252 receives the coordinates of both the bore end 404 and the steering objective location 420. Using these coordinates, the directional planning and monitoring controller 252 may be configured to generate one or more sets of directional motor instructions to drive the BHA 406 from the bore end 404 (or from the BHA's current position) to the steering objective location 420. These directional motor instructions (or steering instructions) may be used for standard directional drilling equipment (such as a bent housing drilling system) and/or RSS drilling equipment. For example, when the BHA 406 is a bent housing drilling system, these directional motor instructions may include a toolface angle (which may be measured relative to gravity high side or map north) and a distance to "slide" the BHA. FIG. 4C shows an example of the curved path 414 of a BHA 406 following the directional motor instructions.

In some implementations, the controller 252 may generate a set of directional motor instructions including RSS steering instructions for driving the BHA 406. In other implementations, the controller 252 may be used to convert the standard motor instructions to instructions for an RSS system. This conversion may occur at a directional planning and monitoring controller 252 on the drilling rig, and may be accomplished using geometric steering logic. In some implementations, the directional motor instructions are derived from a circular arc calculated by the directional planning and monitoring controller 252. This circular arc may be interpolated at the steering objective location, which may be calculated to be about 95 feet from the bore end 404 after the most recent survey. At the terminal end of this arc, a three dimensional vector may be defined with a specific inclination and azimuth. The specific inclination, azimuth, and measured depth at the steering objective location may be transmitted to the RSS system to execute over the drilling interval from current bottom hole location to the steering objective location. In some implementations, the RSS instructions include a target inclination and a rate of inclination change coupled with a target azimuth and a rate of azimuth change. The RSS instructions may be transmitted to the RSS components in the BHA 406. In some implementations, the instructions are transmitted via wireless links. In other implementations, the instructions are transmitted via pulses sent through liquid in the drilling system. These pulses may be created by driving pumps on the drilling system. The instructions may also be transmitted acoustic transmission through the drill string, electronic transmission through a wireline or wired pipe, transmission as electromagnetic pulses, among other methods.

A user may orient RSS components on the BHA 406 to steer the BHA 406 to the steering objective location 420. In some implementations, the route of the BHA 406 using the RSS instructions may be different than the route of the BHA 406 using directional motor instructions for a standard bent housing system. FIG. 4D is an example of the BHA 406 with RSS components being driven according to the RSS instructions. In some implementations, the RSS instructions may support more direct routes to projected locations that directional motor instructions. Additionally, the use of RSS instructions may provide for faster drilling rates than directional motors instructions for bent housings, and may simplify the process of assessing progress.

In some implementations, the directional planning and monitoring controller 252 may be used to determine the position of the BHA 406 at each tubular or stand increment and quickly map a route for the next increment. In doing so, the directional planning and monitoring controller 252 may use directional motor techniques, such as changing the toolface angle and sliding, as well as RSS techniques to optimize the route of the BHA 406.

Figure 4F:
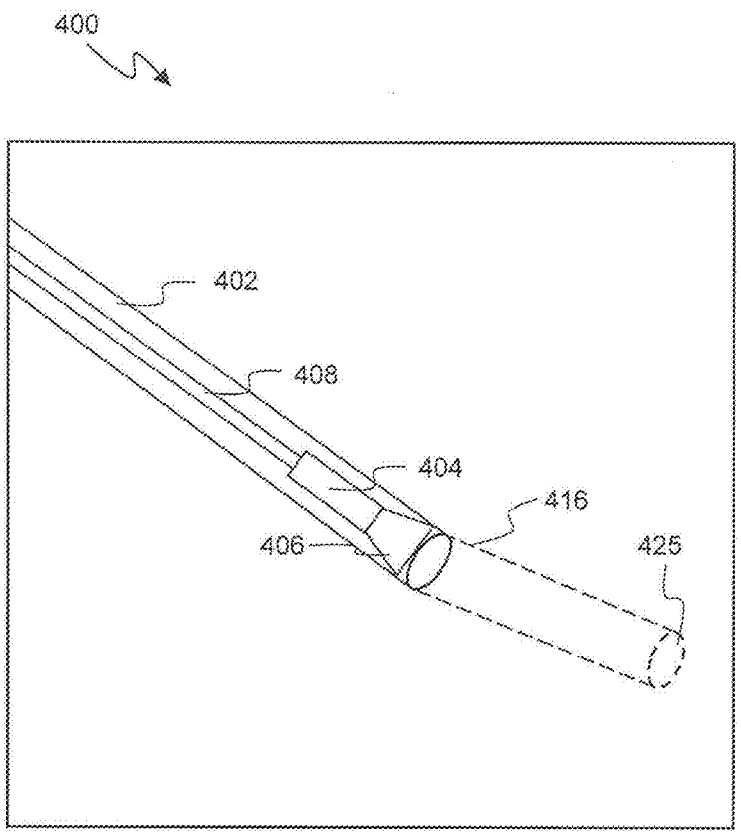
FIG. 4F is another representation of a down hole environment including a wellbore according to one or more aspects of the present disclosure.
Figure 4E:
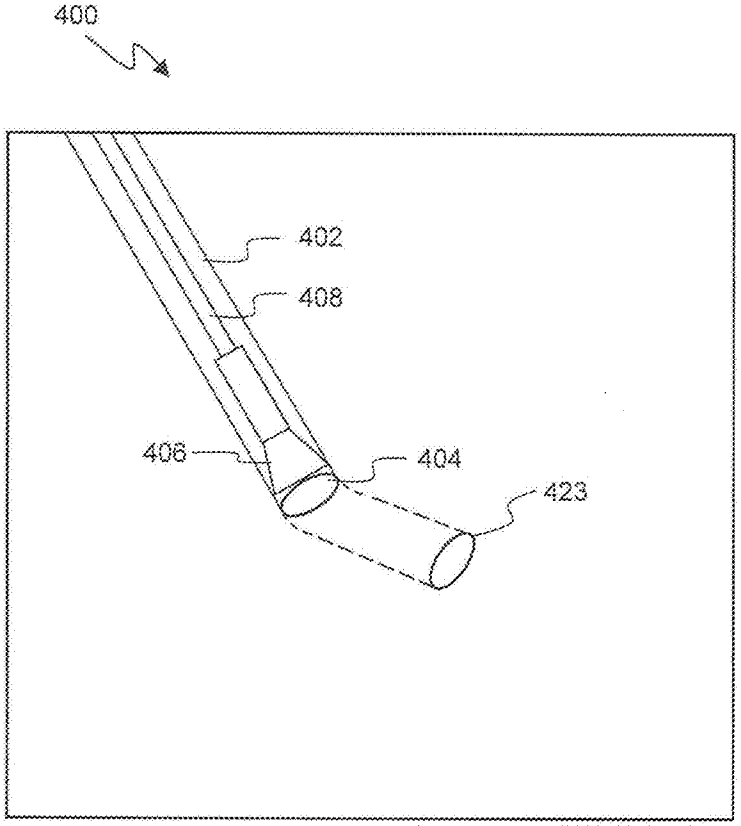
FIG. 4E is another representation of a down hole environment including a wellbore according to one or more aspects of the present disclosure.
Figure 4H:
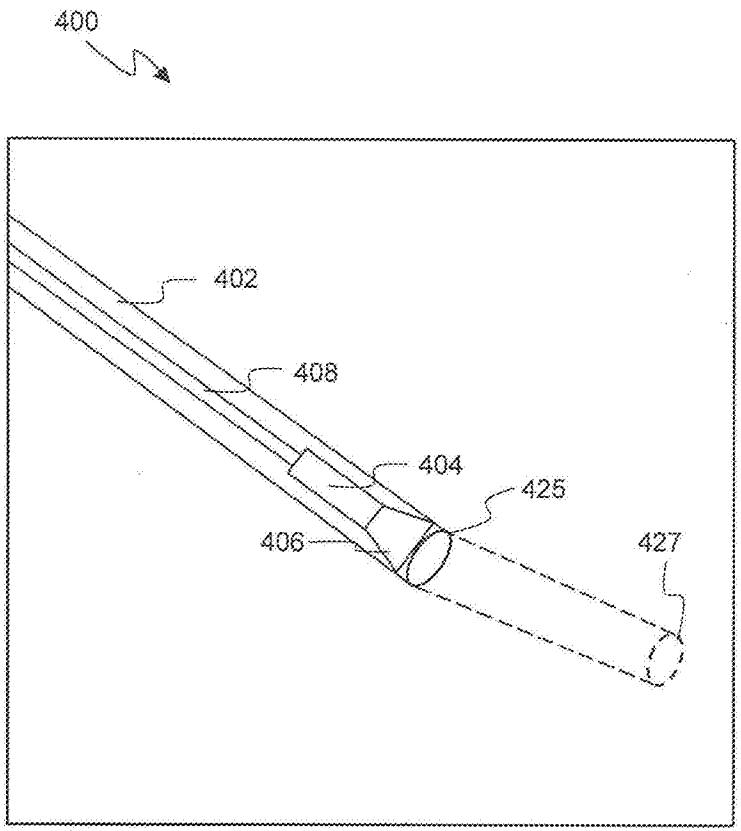
FIG. 4H is another representation of a down hole environment including a wellbore according to one or more aspects of the present disclosure.

The directional planning and monitoring controller 252 may also be configured to forecast instructions for the next incremental section while the current incremental section (from the most recent survey to the steering objective location) is being drilled. For example, FIG. 4E shows a first steering objective location 423 that lies along a well plan. The controller 252 may be used by an operator to generate a first set of drilling instructions to drive the BHA 406 to the first steering objective location 423. As the BHA 406 is driven toward the first steering objective location 423, the controller 252 may be used to generate a second set of drilling instructions to drive the BHA 406 to a second steering objective location 425 as shown in FIG. 4F. Once the BHA 406 is driven to or near the first steering objective location 423, the operator may use the second set of drilling instructions to drive the BHA 406 to the second objective location.

In some implementations, the directional planning and monitoring controller 252 may receive positional data from the BHA 406 before the next upcoming survey is performed. This positional data may be transmitted to the controller from various components on the BHA 406 as well as on other parts of the drilling rig, such as the drawworks. The positional data may be used to predict the next steering objective location as well as any corrections that need to be made to reach the steering objective location. In some implementations, certain geological influences arising from the formations being drilled may adversely influence the control of the drilled path. For example, a particularly hard geological formation may deflect the BHA 406 and cause a deviation from the drill path. These geological influences may be analyzed and the future directional motor or RSS instructions may be adjusted to counteract these adverse geological influences. For example, RSS instructions may be sent to compensate for the deflection due to the BHA 406 contacting a hard geological formation. In some implementations, RSS instructions may be used to compensate for future interactions with formations and thereby serve to "forecast" future control functions. For example, the directional planning and monitoring controller 252 may recognize that the planned route of the BHA 406 passes through a hard formation in the next stand. The directional and monitoring controller 252 may be configured to send control signals the BHA 406 before the BHA 406 reaches the hard formation to compensate for the expected deflection. These changes and compensations may be included in the one or more sets of directional motor instructions.

This forecasting function may reduce the amount of time between increments (introduction of tubulars or stands) by determining the next incremental steering objective location even before the survey results are fully determined. Furthermore, in some implementations, the operations of the controller discussed above may be fully automated. For example, in some implementations, a directional driller operator may press a single button on the user interface 206 (such as a button or the display device 261 shown in FIG. 2) to implement a program to collect positional data from the BHA 406, generate a steering objective location based on the positional data, generate instructions for a directional motor as well as an RSS system, generate a confirmation for the directional driller operator, and ultimately drive the BHA 406 based on either the directional motor instructions or RSS instructions. In some implementations, a selectable button may be presented on the display device 261 that permits an operator to select the next steering objective location or to decline the next steering objective location.

Figure 4G:
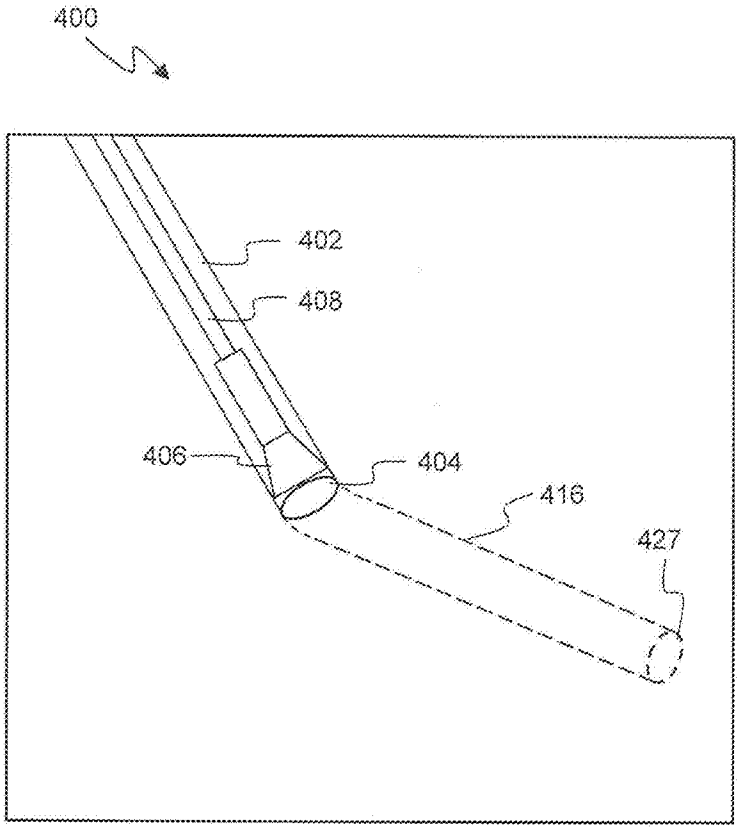
FIG. 4G is another representation of a down hole environment including a wellbore according to one or more aspects of the present disclosure.

In some implementations, the controller 252 may be used to generate one or more sets of drilling instructions to correct a drilling operation or ensure the accuracy of a drilling operation. For example, FIG. 4G shows a BHA 406 and a steering objective location 427. A controller 252 may be used to generate a first set of drilling instructions to drive the BHA 406 to the steering objective location 427. As an operator uses the first step of drilling instructions to drive the BHA 406 to the steering objective location 427, the position of the BHA 406 may be determined (such as by receiving survey information). Based on the updated position 425 of the BHA, the controller 252 may generate a second set of drilling instructions to drive the BHA 406 to the steering objective location 427. In some implementations, the second set of drilling instructions may help to correct the drill path of the BHA 406 or avoid obstacles.

Figure 5:
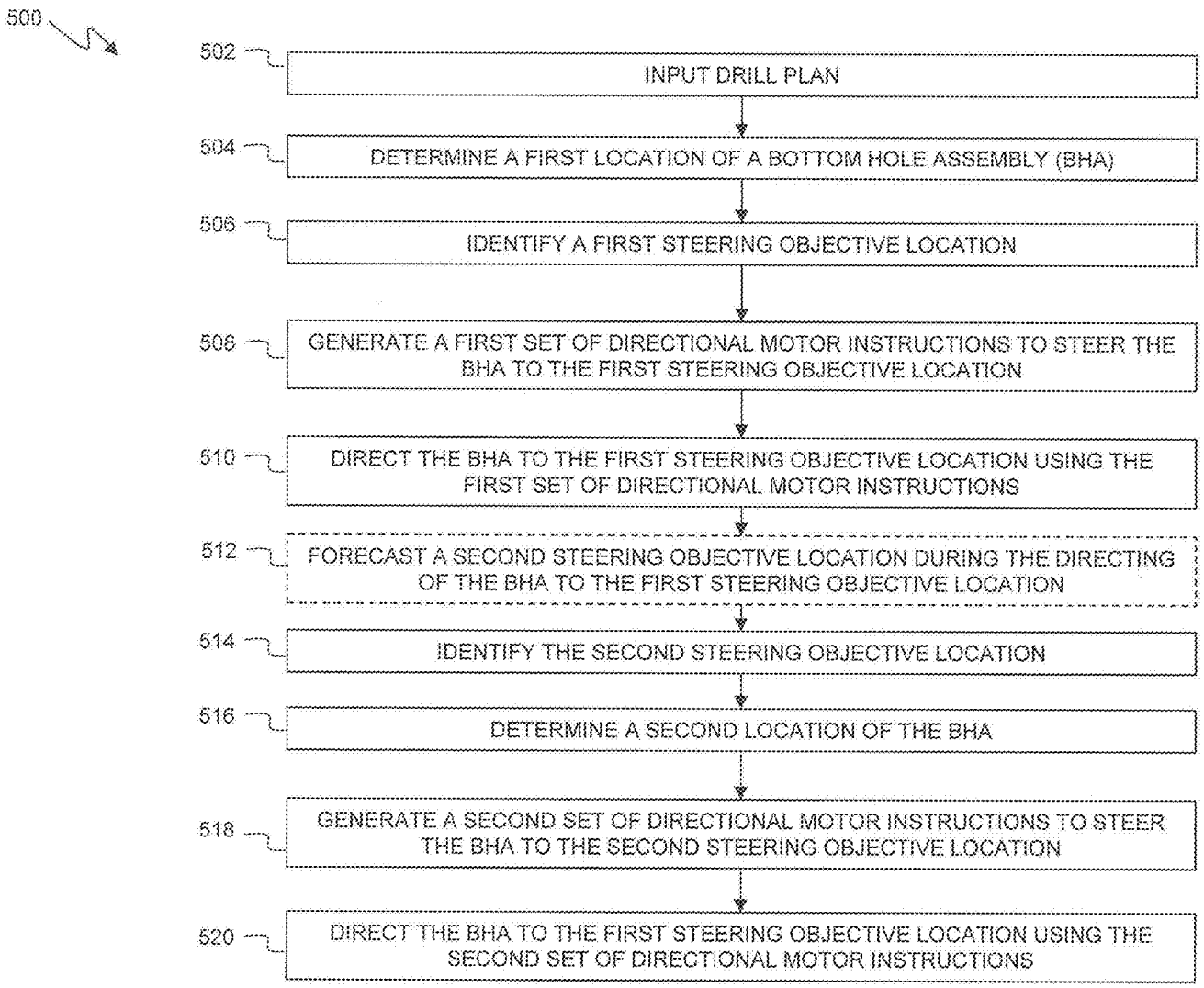
FIG. 5 is a flowchart diagram of a method of directing operation of a drilling system according to one or more aspects of the present disclosure.

FIG. 5 is a flow chart showing a method 500 of steering a BHA. It is understood that additional steps can be provided before, during, and after the steps of method 500, and that some of the steps described can be replaced or eliminated for other implementations of the method 500. In particular, any of the control systems disclosed herein, including those of FIGS. 1 and 2, and the display of FIG. 3, may be used to carry out the method 500.

At step 502, the method 500 may include inputting a drill plan. This may be accomplished by entering location and orientation coordinates into a controller such as the directional planning and monitoring controller 252 discussed with reference to FIG. 2. The drill plan may also be entered via the user interface, and/or downloaded or transferred to directional planning and monitoring controller 252. The directional planning and monitoring controller 252 may therefore receive the drill plan directly from the user interface or a network or disk transfer or from some other location.

At step 504, the method 500 may include determining a first location of a bottom hole assembly (BHA). In some implementations, the BHA is part of a drilling apparatus such as the drilling apparatus 100 discussed in conjunction with FIG. 1. The drilling apparatus 100 may comprise a motor, a toolface, and one or more sensors. The drilling apparatus 100 may include a standard directional drilling system (such as a bent housing) and/or an RSS system. This may include RSS components such as a drilling motor that may be part of the BHA. The RSS components may also include a steering device, such as adjustable skid pads and/or extendable and retractable arms that apply lateral forces along a borehole wall to gradually effect a turn. The drilling apparatus may be operated by a user who inputs commands in a user interface that is connected to the drilling apparatus. The commands may include drilling a hole to advance the BHA through a subterranean formation. The determination of the first position may include receiving, with the directional planning and monitoring controller 252, positional data of the BHA. The positional data may be generated from various sources, including a survey conducted by the BHA at the end of a drilling increment as well as sensors on the drilling rig. In some implementations, positional data is gathered throughout the drilling operation by sensors disposed on the BHA or various other locations on the drilling rig, such as the drawworks. The positional data may be used to determine the location of the BHA at a given moment in time, such as at the end of a drilling increment. With the location of the BHA known, the method proceeds to step 506.

At step 506, the method 500 may include identifying a first steering objective location. This steering objective location may be on a pre-determined drill plan or designated to move the BHA closer to the drill plan. The first steering objective location may be surrounded by a tolerance area. In some implementations, the first steering objective location may be at a predetermined distance from the present location of the BHA, for example, the distance of a drilling increment corresponding to the length of a stand. In some implementations, this first steering objective location is between 87 and 124 feet from the present location of the BHA. The controller may receive sensor data associated with the toolface. This sensor data can originate with sensors located near the toolface in a down hole location, well as sensors located along the drill string or on the drill rig. In some implementations, a combination of controllers, such as those in FIG. 2, receive sensor data from a number of sensors via electronic communication. The controllers then transmit the data to a central location for processing such as the directional planning and monitoring controller 252.

At step 508, the method 500 may include generating a first set of directional motor instructions to steer the BHA to or near the first steering objective location. The directional motor instructions may be standard directional drilling instructions and/or RSS instructions. This step 508 may include calculating the distance from the position of the BHA to the first steering objective location. In some implementations, this distance is approximately the distance of a drilling increment, or about 95 feet. The calculation of the distance between the position of the BHA and the steering objective location may include the comparison of the coordinates of each location. For example, the inclination and azimuth measurements of the position of the BHA may be compared the inclination and azimuth measurements of the first steering objective location. In some implementations, the position of the BHA and the first steering objective location may be compared using a visualization such as may be shown on the display device 261 shown in FIG. 2. The generation of the first set of instructions may include determining if the position of the BHA requires adjustment, and if so, how much adjustment is necessary. The directional motor instructions may include a toolface angle and a distance to "slide" the motor to create a curved path to the first steering objective location. In some implementations, RSS instructions may be generated using coordinates of the first steering objective location, such as an inclination measurement and an azimuth measurement.

Still referring to step 508, the generation of the directional motor instructions may include determining an optimized route to the first steering objective location using the directional motor instructions or the RSS instructions. This optimized route may be based on minimizing parameters such as the time required to drive the BHA to the first steering objective location, the time required to carry out the instructions, and/or the time required to generate a route to future steering objective locations. The optimized route may also take into account lithology information such as the composition of the formations present along the route to the first steering objective location. The optimized route may take into account the time required to reorient the BHA using the directional motor as well as the RSS system, and the drilling speeds of the directional motor and the RSS system.

At step 510, the method 500 may include directing the BHA to the first steering objective location using the first set of directional motor instructions. In some implementations, the operator uses the first set of directional motor instructions as a guide for driving the BHA. In some implementations, this may involve reorienting various components of the BHA including RSS components, using hydraulic systems to drill, and driving the drill bit of the BHA. This step 510 may also include transmitting instructions to the BHA. In some implementations, the instructions are transmitted via wireless links. In other implementations, the instructions are transmitted via pulses sent through liquid in the drilling system. These pulses may be created by driving pumps on the drilling system. The instructions may be received by a dedicated receiver within the BHA.

At step 512, the method 500 may optionally include forecasting a second steering objective location during the directing of the BHA to the first steering objective location. This step 512 may include determining a second location of the BHA and determining if the second location is along an optimal route to the first steering objective location.

In some implementations, the controller may be configured to forecast sets of directional motor instructions for driving the next increment while the current increment is being drilled. For example, the controller may receive positional data from the BHA before the survey at the end of the increment is performed. This positional data may be transmitted to the controller from various components on the BHA as well as on other parts of the drilling rig, such as the drawworks. The positional data may be used to predict the next steering objective location as well as any corrections that need to be made to reach the steering objective location. The forecasting of the second steering objective may take into account the direction of the BHA in relation to the drill plan, the rate of drilling, and environmental conditions such as the composition of surrounding formations. This step 520 may eliminate extra time between increments, such as the time needed to assess the survey results and generate a steering objective location based only on the survey results.

At step 514, the method 500 may include identifying the second steering objective location. Similarly to the first steering objective location, the second steering objective location may be on a pre-determined drill plan or designated to move the BHA closer to the drill plan. The second steering objective location may also be surrounded by a second tolerance area. In some implementations, the second steering objective location is located a stand length away from the first steering objective location.

At step 516, the method 500 may include determining a second location of the BHA. The determination of the second position may include receiving positional data of the BHA from various sources, including a survey conducted by the BHA at the end of a drilling increment as well as sensors on the drilling rig.

At step 518, the method 500 may include generating a second set of directional motor instructions to steer the BHA to the second steering objective location. The second set of directional motor instructions may be standard directional drilling instructions and/or RSS instructions. Similarly to the first set of directional motor instructions, the second set of directional motor instructions may include determining a distance between the BHA and the second steering objective location, determining an optimized path, avoiding obstacles, as well as other steps.

In some implementations, the generation of the first and second sets of directional motor instructions in steps 508 and 518 may include displaying the sets of directional motor instructions and/or optimized route to a user, such as a directional driller. The optimized route may be displayed on a display device such as display device 261 shown in FIG. 2. In some implementations, the optimized route is shown as a two-dimensional or three-dimensional visualization. This visualization may be accompanied with symbolic or textual information. The optimized route may be displayed to a user with the directional motor and/or RSS instructions. In some implementations, a user is able to approve or override the optimized route at this steps 508 and 518. For example, the optimized route may be displayed to the user via a single button. The user may be able to quickly assess the optimized route, the method of drilling, and other information (such as the time required for drilling, the coordinates of various targets, etc.) and press the button to proceed. Options may also be displayed to the user at other stages of the drilling process, such as during steps 506-520. In this case, the user may be able to approve or override the system at each step.

At step 520, the method 500 may include directing the BHA to the second steering objective location using the second set of directional motor instructions. In some implementations, the operator uses the second set of directional motor instructions as a guide for driving the BHA. In some implementations, this may involve reorienting various components of the BHA including RSS components, using hydraulic systems to drill, and driving the drill bit of the BHA.

In an exemplary implementation within the scope of the present disclosure, the method 500 repeats after step 520, such that method flow goes back to step 504 and begins again. Iteration of the method 500 may be utilized to carry out a drilling operation including a number of increments.

In view of all of the above and the figures, one of ordinary skill in the art will readily recognize that the present disclosure introduces a method of directing operation of a drilling system, which may include: receiving a drill plan at a controller in communication with the drilling system; receiving, with the controller, first survey data of a bottom hole assembly (BHA) of the drilling system at an initial location; determining, with the controller, a first location of the BHA based on the first survey data; identifying, with the controller, a first steering objective location; generating, with the controller, a first set of directional motor instructions to steer the BHA from the first location to a first tolerance area around the first steering objective location; directing the BHA using the first set of directional motor instructions; identifying, with the controller, a second steering objective location; receiving, with the controller, second survey data of the BHA at a second location; determining, with the controller, a second location of the BHA based on the second survey data; generating, with the controller, a second set of directional motor instructions to steer the BHA from the second location to a second tolerance area around a second steering objective location; and directing the BHA using the second set of directional motor instructions.

The method may also include identifying, with the controller, the second tolerance area while directing the BHA using the first set of directional motor instructions. The second tolerance area may be identified based on positional data received from sensors in the BHA. The first and second sets of directional motor instructions may include a distance to slide, a toolface angle, and a distance to rotate. The directing the BHA to the first tolerance area around the first steering objective location may include altering one or more surface parameters to reorient a toolface of the BHA.

In some implementations, the one or more surface parameters include rotating a drill pipe. The first steering objective location may be located along the drill plan. The method may also include displaying the drill plan, the first steering objective location, and the first tolerance area to a user on a display device. The method may also include displaying a three-dimensional depiction of the drill plan, the first tolerance area, the first steering objective location, the second tolerance area, and the second steering objective location to a user on a display device.

A method of operating a drilling system is also provided, which may include: inputting a drill plan into a controller in communication with the drilling system; receiving, with the controller, positional data of a bottom hole assembly (BHA) of the drilling system at an initial location; identifying, with the controller, a first steering objective location on the drill plan and a first tolerance area around the first steering objective location; generating, with the controller, a first set of directional motor instructions to steer the BHA to the first tolerance area; directing the BHA to the first tolerance area; while directing the BHA to the first tolerance area, identifying a second steering objective location on the drill plan and a second tolerance area around the second steering objective location; generating, with the controller, a second set of directional motor instructions to steer the BHA to the second tolerance area; and directing the BHA to the second tolerance area.

In some implementations, the method further includes displaying the drill plan, the first steering objective location, and the first tolerance area to a user on a display device. The method may also include displaying a three-dimensional depiction of the drill plan, the first tolerance area, the first steering objective location, the second tolerance area, and the second steering objective location to a user on a display device. The positional data of the BHA may be derived from a drilling survey. The positional data of the BHA may be derived from one or more sensors within the BHA. The first and second sets of directional motor instructions may include a distance to slide, a toolface angle, and a distance to rotate. In some implementations, the directing the BHA to the first tolerance area around the first steering objective location comprises altering one or more surface parameters to reorient a toolface of the BHA. The generating the first set of directional motor instructions may include determining an optimized route to the first tolerance area based on a least amount of time required to drive the BHA to the first tolerance area.

A drilling apparatus is also provided, which may include: a drill string comprising a plurality of tubulars; a top drive unit configured to rotate the drill string; a bottom hole assembly (BHA) disposed at a distal end of the drill string; a sensor system connected to the drill string and configured to detect one or more measureable parameters of the BHA, the one or more measureable parameters indicative of a position and an orientation of the BHA at an initial location; a controller in communication with the top drive unit, the BHA, and the sensor system, wherein the controller is configured to: identify a first tolerance area around a first steering objective location; generate a first set of directional motor instructions to drive the BHA to the first tolerance area; identify a second tolerance area around a second steering objective location; and generate a second set of directional motor instructions to drive the BHA to the second tolerance area; and a display device configured to display the first and second sets of directional motor instructions to a user.

The controller may be further configured to: drive the BHA to the first tolerance area using the first set of directional motor instructions; and drive the BHA to the second tolerance area using the second set of directional motor instructions. The controller may be configured to generate the second set of directional motor instructions while the BHA is driven to the first tolerance area. The display device may be further configured to display a three-dimensional depiction of the first tolerance area, the first steering objective location, the second tolerance area, and the second steering objective location.

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A method of directing operation of a drilling system, comprising:

receiving, with a controller in communication with the drilling system, first survey data of a bottom hole assembly (BHA) of the drilling system at an initial location;

determining, with the controller, a first location of the BHA based on the first survey data;

identifying, with the controller, a first steering objective location along a drill plan;

generating, with the controller, a first set of directional motor instructions to steer the BHA from the first location to a first tolerance area around the first steering objective location;

directing the BHA using the first set of directional motor instructions;

during the directing of the BHA using the first set of directional motor instructions, forecasting, with the controller, a second steering objective location based on an expected deflection of the BHA during the directing of the BHA using the first set of directional motor instructions;

generating, with the controller, a second set of directional motor instructions to steer the BHA to a second tolerance area around the second steering objective location;

receiving, with the controller, second survey data of the BHA at a second location further along the drill plan than the first steering objective location;

displaying a three-dimensional depiction of the first tolerance area, the first steering objective location, the second tolerance area, and the second steering objective location to a user on a display device during the directing of the BHA using the first set of directional motor instructions; and directing the BHA using the second set of directional motor instructions.

2. The method of claim 1, wherein the second tolerance area is forecasted based on positional data received from sensors in the BHA.

3. The method of claim 1, wherein the first and second sets of directional motor instructions comprise a distance to slide, a toolface angle, and a distance to rotate.

4. The method of claim 1, wherein the directing the BHA to the first tolerance area around the first steering objective location comprises altering one or more surface parameters to reorient a toolface of the BHA.

5. The method of claim 4, wherein the one or more surface parameters comprise rotating a drill pipe.

6. The method of claim 1, further comprising receiving a drill plan with the controller, wherein the first steering objective location is located along the drill plan.

7. The method of claim 1, further comprising displaying the first and second survey data to the user on the display device.

8. The method of claim 1, further comprising directing the BHA using the displayed three-dimensional depiction of the first tolerance area, the first steering objective location, the second tolerance area, and the second steering objective location as a reference.

9. A method of operating a drilling system, comprising:

receiving, with a controller in communication with the drilling system, positional data of a bottom hole assembly (BHA) of the drilling system at an initial location;

identifying, with the controller, a first steering objective location and a first tolerance area around the first steering objective location;

generating, with the controller, a first set of directional motor instructions to steer the BHA to the first tolerance area;

directing the BHA to the first tolerance area;

while directing the BHA to the first tolerance area, forecasting, with the controller, a second steering objective location and a second tolerance area around the second steering objective location;

while directing the BHA to the first tolerance area, generating, with the controller, a second set of directional motor instructions to steer the BHA to the second tolerance area;

displaying a three-dimensional depiction of the first tolerance area and the second tolerance area with reference to a drill plan, the first steering objective location, the second tolerance area, and the second steering objective location to a user on a display device; and directing the BHA to the second tolerance area.

10. The method of claim 9, further comprising displaying the first steering objective location and the first tolerance area to a user on a display device.

11. The method of claim 9, further comprising displaying a three-dimensional depiction of the first tolerance area, the first steering objective location, the second tolerance area, and the second steering objective location to a user on a display device.

12. The method of claim 9, wherein the positional data of the BHA is derived from a drilling survey.

13. The method of claim 9, wherein the positional data of the BHA is derived from one or more sensors within the BHA.

14. The method of claim 9, wherein the first and second sets of directional motor instructions comprise a distance to slide, a toolface angle, and a distance to rotate.

15. The method of claim 9, wherein the directing the BHA to the first tolerance area around the first steering objective location comprises altering one or more surface parameters to reorient a toolface of the BHA.

16. The method of claim 9, wherein the generating the first set of directional motor instructions includes determining an optimized route to the first tolerance area based on a least amount of time required to drive the BHA to the first tolerance area.

17. A drilling apparatus comprising:

a drill string comprising a plurality of tubulars;

a top drive unit configured to rotate the drill string;

a bottom hole assembly (BHA) disposed at a distal end of the drill string;

a sensor system connected to the drill string and configured to detect one or more measurable parameters of the BHA, the one or more measurable parameters indicative of a position and an orientation of the BHA at an initial location;

a controller in communication with the top drive unit, the BHA, and the sensor system, wherein the controller is configured to:

identify a first tolerance area around a first steering objective location;

generate a first set of directional motor instructions to drive the BHA to the first tolerance area;

while directing the BHA to the first tolerance area, forecast a second tolerance area around a second steering objective location based on an expected deflection of the BHA during the directing of the BHA using the first set of directional motor instructions; and generate a second set of directional motor instructions to drive the BHA to the second tolerance area; and a display device configured to display the first and second sets of directional motor instructions, a three-dimensional depiction of the first steering objective location, the first tolerance area, the second steering objective location, and the second tolerance area to a user.

18. The apparatus of claim 17, wherein the controller is further configured to:

drive the BHA to the first tolerance area using the first set of directional motor instructions; and drive the BHA to the second tolerance area using the second set of directional motor instructions.

19. The apparatus of claim 18, wherein the controller is configured to generate the second set of directional motor instructions while the BHA is driven to the first tolerance area.

20. The apparatus of claim 17, wherein the display device is further configured to display a three-dimensional depiction of a drill plan in reference to the first tolerance area, the first steering objective location, the second tolerance area, and the second steering objective location.

21. A method of directing operation of a drilling system, comprising:

receiving, with a controller in communication with the drilling system, first survey data of a bottom hole assembly (BHA) of the drilling system at an initial location;

determining, with the controller, a first location of the BHA based on the first survey data;

identifying, with the controller, a first steering objective location;

generating, with the controller, a first set of rotary steerable system (RSS) instructions to steer the BHA from the first location to a first tolerance area around the first steering objective location;

directing the BHA using the first set of RSS instructions;

while directing the BHA using the first set of RSS instructions, forecasting, with the controller, a second steering objective location;

receiving, with the controller, second survey data of the BHA at a second location;

determining, with the controller, a second location of the BHA based on the second survey data;

while directing the BHA using the first set of RSS instructions, generating, with the controller, a second set of RSS instructions to steer the BHA from the second location to a second tolerance area around a second steering objective location based on an expected deflection of the BHA during the directing of the BHA using the first set of RSS instructions;

displaying a three-dimensional depiction of the first tolerance area, the first steering objective location, the second tolerance area, and the second steering objective location to a user on a display device; and directing the BHA using the second set of RSS instructions and display as a reference.

22. The method of claim 21, wherein directing the BHA using the first and second sets of RSS instructions comprises applying force to a wall of a wellbore with one or more adjustable skid pad or adjusting an offset of a near bit stabilizer.

23. The method of claim 22, wherein the second tolerance area is identified based on positional data received from sensors in the BHA.

24. The method of claim 22, wherein the first and second sets of RSS instructions comprise inclination and azimuth measurements.

* * * * *